US007289068B2

(12) United States Patent
Fujio et al.

(10) Patent No.: US 7,289,068 B2
(45) Date of Patent: Oct. 30, 2007

(54) PLANAR ANTENNA WITH MULTIPLE RADIATORS AND NOTCHED GROUND PATTERN

(75) Inventors: Shohhei Fujio, Machida (JP); Kazuo Masuda, Kamakura (JP); Takeshi Asano, Atsugi (JP); Masahiro Tsumita, Zama (JP); Masaki Kinugasa, Sagamihara (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 11/475,658

(22) Filed: Jun. 27, 2006

(65) Prior Publication Data

US 2007/0001911 A1 Jan. 4, 2007

(30) Foreign Application Priority Data

Jun. 30, 2005 (JP) ..... 2005-192363

(51) Int. Cl.
*H01Q 1/38* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 6,624,789 B1 * 9/2003 Kangasvieri et al. ..... 343/702

FOREIGN PATENT DOCUMENTS

| | | |
|---|---|---|
| JP | 2001-119238 | 4/2001 |
| JP | 2004-186931 | 7/2004 |

* cited by examiner

*Primary Examiner*—Hoang V. Nguyen
(74) *Attorney, Agent, or Firm*—John L. Rogitz

(57) ABSTRACT

An antenna consisting of a single small and lightweight package, where each radiating element operates independently with reduced interference among the radiating elements. An integrated multi-element planar antenna includes a ground pattern 2 with a notch 2*b* formed at an end 2*a*, first radiating element 3 placed on one side of the notch 2*b* and equipped with a feeder 5, and second radiating element 4 placed on the other side of the notch 2*b* and equipped with a feeder 5. For example, inverted F antennas are used as the first radiating element 3 and second radiating element 4. The first radiating element 3 and second radiating element 4 are placed symmetrically about the notch 2*b* such that separation distance will be the largest at locations where their radiation fields are the highest.

25 Claims, 9 Drawing Sheets

(a)

(b)

PLANAR ANTENNA WITH MULTIPLE RADIATORS AND NOTCHED GROUND PATTERN

RELATED APPLICATION

This application claims priority from Japanese patent application serial No. 2005-192363, filed Jun. 30, 2005.

I. FIELD OF THE INVENTION

The present invention relates to an integral-type planar antenna equipped with multiple radiating elements adapting to the same frequency band. More particularly, it relates to an integral-type planar antenna with reduced mutual interference among multiple antenna elements.

II . BACKGROUND OF THE INVENTION

As transmission techniques for increasing communications speed of wireless LANs, MIMO/SDM (Multiple Input Multiple Output/Space Division Multiplexing), MIMO/SM (Multiple Input Multiple Output/Spatial Multiplexing), and other MIMO communications systems are considered promising. In simultaneous communication, by installing multiple transmitting antennas and receiving antennas, assigning different channels in the same frequency band to different transmitting antennas, and transmitting different sequences of signals to the different channels simultaneously, it is possible to increase transmission speed without expanding the frequency band. Thus, even if the frequency band is not expanded, it is possible to increase sequences of transmission signals with increases in the number of transmitting antennas, and thereby improve the usability of frequencies and increase the wireless transmission speed. To this end, Japanese Patent Application No. 2001-119238 describes an antenna device comprising a first planar inverted F antenna and a second planar inverted F antenna installed symmetrically about a printed circuit board.

Thus, to implement a MIMO communications system, one communications device must have multiple broadband antennas, and when installing multiple antennas, as recognized herein it is necessary to provide sufficient space among the antennas to avoid interference among the antennas. The present invention understands that in MIMO communications systems, when n antennas constitute independent frequency channels, if data transfer speed per channel is A (bps), the data transfer speed T (bps) of all the antennas is nA. However, as recognized herein if there is interference among the antennas, the data transfer speed T is smaller than nA.

Recently, mobile information terminal devices have come into wide use, requiring high transmission speed even from mobile personal computers, PDAs, cell phones, or the like, but as recognized by the present invention, on small information terminal devices, it is difficult to provide enough space between antennas to reduce interference among them. Furthermore, the present invention recognizes that the size of the antennas used for small information terminals should be minimized as much as possible. Additionally, as understood by the present invention, to overcome spatial constraints and to mount a MIMO-compatible antenna on a small information terminal, it is convenient that the antenna be an integral-type multi-element antenna with multiple radiating elements formed in a single package. With these critical observations in mind, the invention herein is provided.

SUMMARY OF THE INVENTION

In one aspect, multiple radiating elements and a ground pattern are formed that are part of an antenna in a single package. Also, notches can be formed in the ground pattern between the radiating elements, thereby reducing electromagnetic interaction among the radiating elements, reducing the degree of coupling among the radiating elements (hereinafter referred to as "the degree of coupling among antenna elements"), and separating characteristics among the multiple radiating elements. In other words, the notches in the ground pattern reduce the degree of coupling among multiple independent antennas without requiring excessive space between the antennas. The present notches can be applied to any antenna that is equipped with a planar ground plane and radiating elements extending radially from the ground plane.

The degree of coupling among antenna elements can be regarded as a radio transfer factor which represents reduction in power gain of the antenna elements due to electromagnetic interaction among the antenna elements. The lower the degree of coupling among antenna elements, the easier for the individual antennas to operate independently. The degree of coupling among antenna elements is known as "S21" in electromagnetics.

The degree of coupling among antenna elements can also be expressed in terms of a correlation coefficient. The correlation coefficient is calculated by measuring radio field intensities of radiating elements on different frequency channels in a Rayleigh fading environment free of direct waves. There is no absolute standard for the correlation coefficient, but the smaller the correlation coefficient, the greater the transfer rate. The correlation coefficient represents similarity among signals received by different radiating elements in the same environment. Although the correlation coefficient and the degree of coupling among antenna elements have different physical meanings, radiating elements with a lower degree of coupling among antenna elements tend to have a lower correlation coefficient, and thus the correlation coefficient is suitable for use in MIMO communications systems.

In any case, according to a first aspect of the present invention, an integrated multi-element planar antenna includes a ground pattern with a notch formed at one end. A first radiating element is equipped with a feeder placed on one side of the notch, and a second radiating element is equipped with a feeder placed on the other side of the notch.

According to a second aspect of the present invention, an integrated multi-element planar antenna includes a ground pattern, a first radiating element disposed at an end of the ground pattern and equipped with a feeder, and a second radiating element disposed adjacent to the first radiating element at the end of the ground pattern and equipped with a feeder. A third radiating element may be disposed adjacent to the second radiating element at the end of the ground pattern, and the third element is also equipped with a feeder. A first notch is formed at the end of the ground pattern between the first radiating element and the second radiating element.

According to a third aspect of the present invention, an integrated multi-element planar antenna has a ground pattern and n radiating elements placed adjacent to each other at an end of the ground pattern. Each radiating element includes a respective feeder. A total of n−1 notches are formed between the n radiating elements at the end of the ground pattern.

Each of the above aspects allows an antenna in a single small and lightweight package to make each radiating element operate independently with reduced interference among the radiating elements. This makes it possible to reduce mounting space of the antenna as well as the number of parts. This in turn makes part management and installation easier, resulting in improved yields and reduced costs.

The present invention makes it possible to provide a small integrated multi-element planar antenna with reduced interference among radiating elements. Also, the present invention makes it possible to provide an integrated multi-element planar antenna compatible with MIMO communications systems. Furthermore, the present invention makes it possible to provide a wireless LAN card and electronic apparatus employing the antenna.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
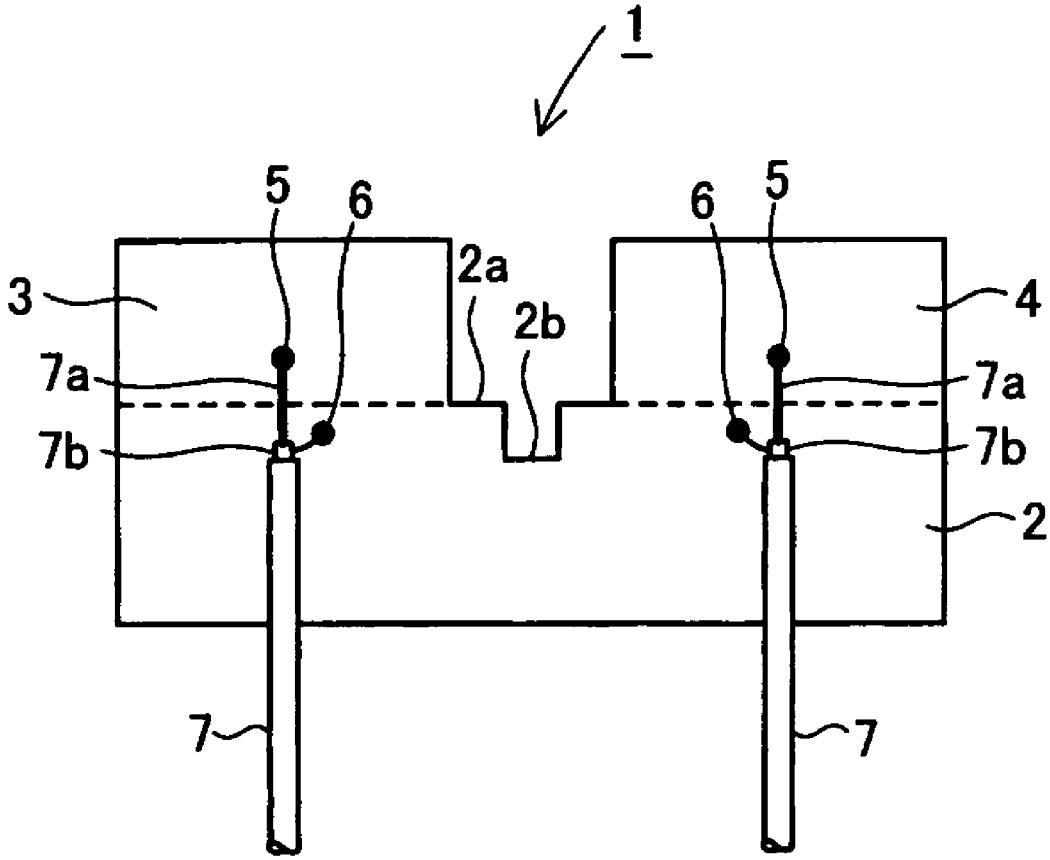
FIG. 1 is a schematic block diagram showing an integrated multi-element planar antenna according to a first embodiment of the present invention.

Preferred embodiments of an integrated multi-element planar antenna according to the present invention will be described below with reference to the drawings. FIG. 1 is a schematic block diagram showing an integrated multi-element planar antenna according to a first preferred embodiment of the present invention. As shown in FIG. 1, the integrated multi-element planar antenna according to the first non-limiting embodiment of the present invention has a ground pattern 2, first radiating element 3, and second radiating element 4. The ground pattern 2, for example, is rectangular in shape and has a notch 2*b* at an end 2*a* on one flank. The first radiating element 3 is placed on one side of the notch 2*b*, and the second radiating element 4 on the other side. Specifically, the first radiating element 3 and second radiating element 4 are formed at the end 2*a* on one flank of the ground pattern 2 and the notch 2*b* is located between the first radiating element 3 and second radiating element 4. The notch 2*b* in the ground pattern 2 makes it possible to reduce the degree of coupling among the antenna elements, and thereby separate antenna characteristics between the two radiating elements. It is to be understood that there is no need for the ground pattern 2 to be flat as a whole. Even if it is bent on account of its mounting space, there is no change in the antenna characteristics.

The integrated multi-element planar antenna 1 has a feeder 5 provided for each of the radiating elements 3 and 4. Grounds 6 for the feeders 5 are installed on the ground pattern 2. Each of the feeders 5 is connected to a component (not shown) by a respective core wire 7*a*, e.g., an inner conductor of a coaxial cable 7, which serves as a feeder cable, while each of the grounds 6 may be connected to a respective ground connector 7*b* that can be a braided wire which is an outer conductor of a coaxial cable. The locations of the feeders 5 and their distances from the ground 6 can be established as desired to achieve a desired impedance adjustment.

The first radiating element 3 and second radiating element 4 of the integrated multi-element planar antenna 1 are configured, for example, for the same frequency band. If the first radiating element 3 and second radiating element 4 are adapted to the same frequency band, by assigning different channels in the same frequency band to the radiating elements and transmitting different sequences of signals to the different channels simultaneously, it is possible to increase transmission speed without expanding the frequency band. This in turn makes it possible to support MIMO communications systems. The 2.4-GHz band used for wireless LANs is suitable as this type of frequency band because it can be used by communications stations without a radio station license. The first radiating element 3 and second radiating element 4 thus may be configured to resonate with frequencies in the 2.4-GHz band at a quarter-wavelength. It is to be understood that the 5-GHz band or other frequency band used for wireless LANs may be used instead of the 2.4-GHz band.

Alternatively, the first radiating element 3 and second radiating element 4 may be configured to adapt to different frequency bands. For example, the first radiating element 3 and second radiating element 4 can be adapted to respective frequency bands that are different from each other. If these two frequency bands are the 2.4-GHz and 5-GHz bands, the antenna can be used for a wireless LAN.

The first radiating element 3 and second radiating element 4 are preferably disposed such that the separation distance will be the largest at locations where their radiation fields are the highest. This arrangement makes it possible to set radiation directivity of the first radiating element 3 and second radiating element 4 to different directions, and thus reduce a correlation coefficient of the antenna. The reduced correlation coefficient of the antenna makes channels independent from each other, and thus makes the antenna compatible with MIMO communications systems. Incidentally, a large correlation coefficient of the antenna means that the two channels are receiving the same signal, and thus makes it difficult to increase the transfer rate in the case of the MIMO communications systems. Therefore, it is preferable that the directivity of the first radiating element 3 and second radiating element 4 can be selectively set to different directions to form different propagation paths for radio waves. For example, preferably the first radiating element 3 and second radiating element 4 are placed symmetrically about the notch 2*b* such that separation distance will be the largest at locations where their radiation fields are the highest. If the first radiating element 3 and second radiating element 4 are of the same material and same shape, when they are placed symmetrically about the notch 2*b*, they give the same characteristic impedance.

Asymmetrical arrangement of the antenna elements is preferable in that it reduces the degree of coupling among the antenna elements, but it lowers directivity characteristics. To increase transfer rates in MIMO communications systems, it is necessary to form different propagation paths for radio waves by varying directivity between the two radiating elements, and thus asymmetrical arrangement which would cause the directivity characteristics of the two radiating elements to overlap is not desirable. Also, it is not desirable to place the first radiating element 3 and second radiating element 4 symmetrically in an inward direction such that the locations at which the radiation fields of the first radiating element and the second radiating element are the highest would face inward because then the locations at which the radiation fields are the highest would be brought close to each other, increasing the degree of coupling among the antenna elements.

Furthermore, if the wavelength corresponding to the resonance frequency (in Gigahertz) of the first radiating element 3 and second radiating element 4 is $\lambda$ and the depth of the notch 2*b* is L (in millimeters), then preferably $L/\lambda$ is between 0.1 and 0.3 (both inclusive). When $L/\lambda$ is between 0.1 and 0.3 (both inclusive), the degree of coupling among the antenna elements can be reduced more than when there is no notch.

In the integrated multi-element planar antenna 1 configured as described above, the ground pattern 2, first radiating element 3, and second radiating element 4 are formed on a dielectric, for example. By forming the antenna on a dielectric, it is possible to make it thin and planar. Alternatively, in the integrated multi-element planar antenna 1, the ground pattern 2, first radiating element 3, and second radiating element 4 may be formed by etching a conductor layer of a flexible printed circuit board. By forming the antenna on a conductor layer of a flexible printed circuit board, it is possible to give flexibility to the antenna itself, and thus easier to incorporate the antenna into a small information terminal device such as a portable personal computer, PDA, or cell phone.

Figure 2:
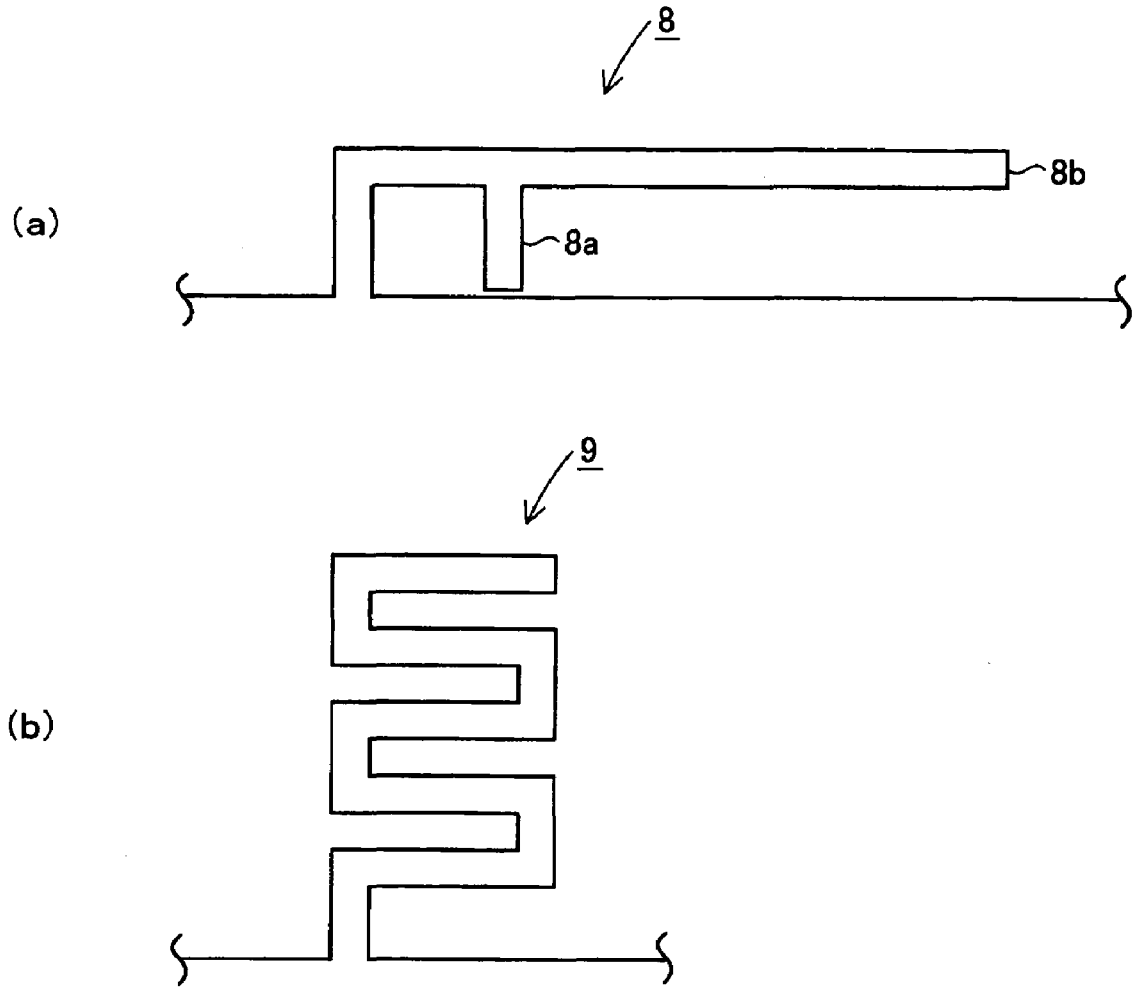
FIGS. 2A and 2B show example radiating elements, with FIG. 2A showing an inverted F antenna and FIG. 2B showing a meander line antenna.
Figure 3:
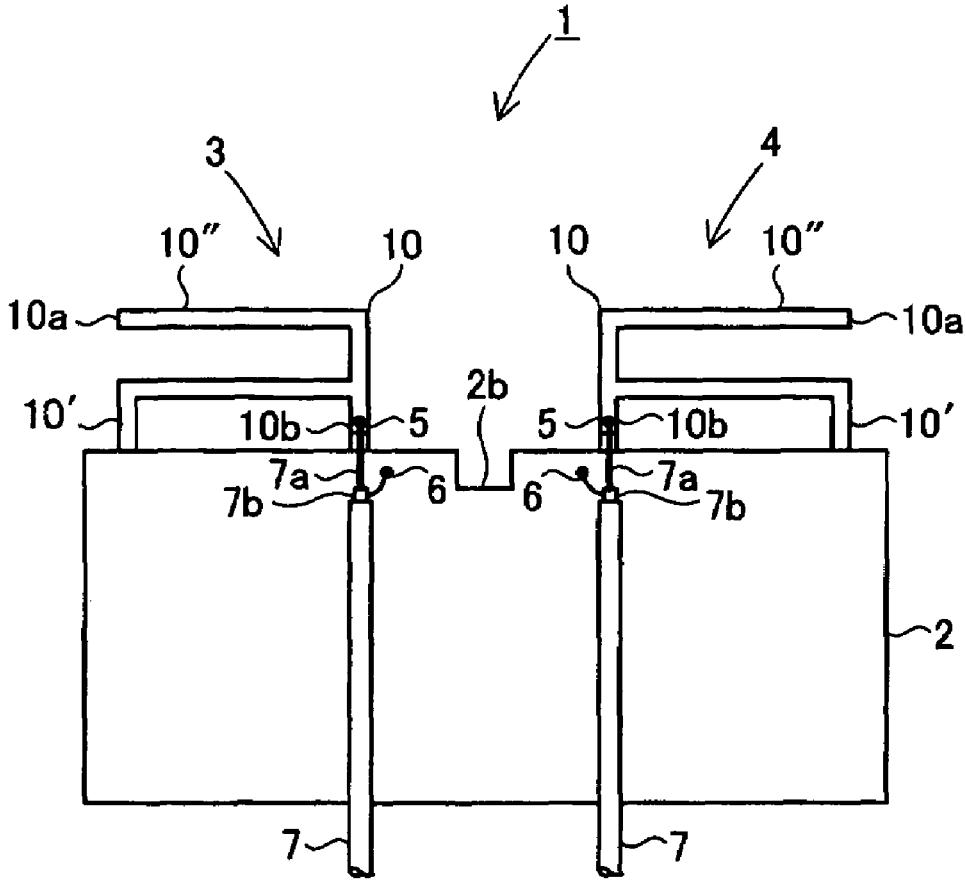
FIG. 3 is a diagram showing a configuration of a composite antenna which is an example of the first radiating element and second radiating element according to the first embodiment of the present invention.

An inverted F antenna, meander line antenna, monopole antenna, or the like is suitable for the first radiating element 3 and second radiating element 4 of the integrated multi-element planar antenna 1. FIG. 2A is a diagram showing a configuration of an inverted F antenna and FIG. 2B is a diagram showing a configuration of a meander line antenna. FIG. 3 is a diagram showing a configuration of a composite antenna.

The inverted F antenna 8 shown in FIG. 2A is configured by bending a quarter-wavelength monopole antenna at a predetermined position from its tip to reduce its height. In so doing, a position of a feeder pin 8*a* is established for impedance adjustment. The radiation field is the highest at a tip 8*b* of the inverted F antenna 8. Thus, if the inverted F antennas are used for the first radiating element 3 and second radiating element 4 of the integrated multi-element planar antenna 1, the first radiating element 3 and second radiating element 4 preferably are placed symmetrically with their tips 8*b* facing outward.

The meander line antenna 9 shown in FIG. 2B has a meander structure with U-shaped bends formed on the left and right alternately.

As shown in FIG. 3, each of the first radiating element 3 and second radiating element 4 of the integrated multi-element planar antenna 1 may be a composite antenna 10 formed by integrating a loop antenna 10' and monopole antenna 10". The resulting composite antenna 10 can also be considered to be an antenna of a special meander structure with the loop antenna 10' accommodating high frequencies and the monopole antenna 10" accommodating low frequencies, and thus the overall antenna can adapt to two frequency bands of 2.4-GHz and 5-GHz.

In both the first radiating element 3 and second radiating element 4 shown in FIG. 3, the composite antenna 10 consists of the loop antenna 10' formed into a rectangle and the monopole antenna 10" bent into an L-shape. The radiation field is the highest at a tip 10*a* of the monopole antenna 10", and thus the first radiating element 3 and second radiating element 4 are placed symmetrically with their tips 10*a* facing outward. The first radiating element 3 and second radiating element 4 each have a feeder 5 on that side 10*b* of the loop antenna 10' which is located on the side of the notch 2*b* in the ground pattern 2. Grounds 6 for the feeders 5 are installed on the ground pattern 2. Each of the feeders 5 is connected with a core wire 7*a*, e.g., an inner conductor of a coaxial cable 7 serving as a feeder cable and each of the grounds 6 can be connected to a braided wire 7*b* serving as an outer conductor of the coaxial cable 7.

Since the integrated multi-element planar antenna 1 with such composite antennas can make the monopole antennas 10" resonate with the 2.4-GHz band at $\frac{1}{4}\lambda$ and make the loop antennas 10' resonate with the 5-GHz band at $\frac{1}{2}\lambda$, it can fit the first radiating element 3 and second radiating element 4 in a space 10 mm long and 21 mm wide and shape the ground pattern 2 into a rectangle 20 mm long and 45 mm wide. Such size reduction is possible because the notch 2*b* formed in the ground pattern 2 between the first radiating element 3 and second radiating element 4 allows the first radiating element 3 and second radiating element 4 to be installed close to each other. Whereas conventional techniques can make only single-element antennas compliant with the small WFF (Wireless Form Factor) standard, the present invention can make two-element antennas compliant with the standard.

Figure 4:
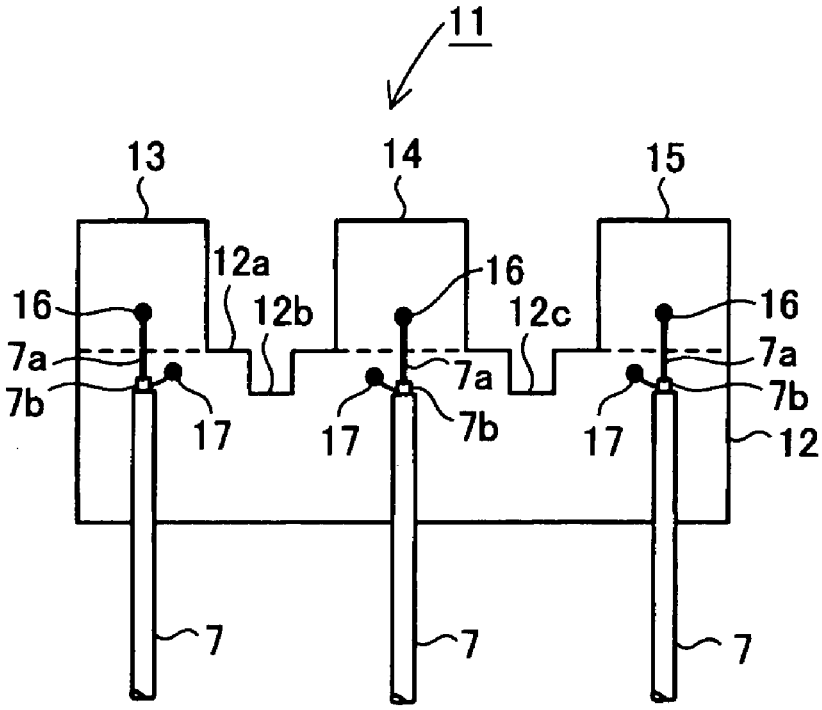
FIGS. 4A and 4B show an integrated multi-element planar antenna according to a second embodiment of the present invention, with FIG. 4A showing an antenna with three radiating elements and FIG. 4B showing an antenna with four radiating elements.
Figure 4:
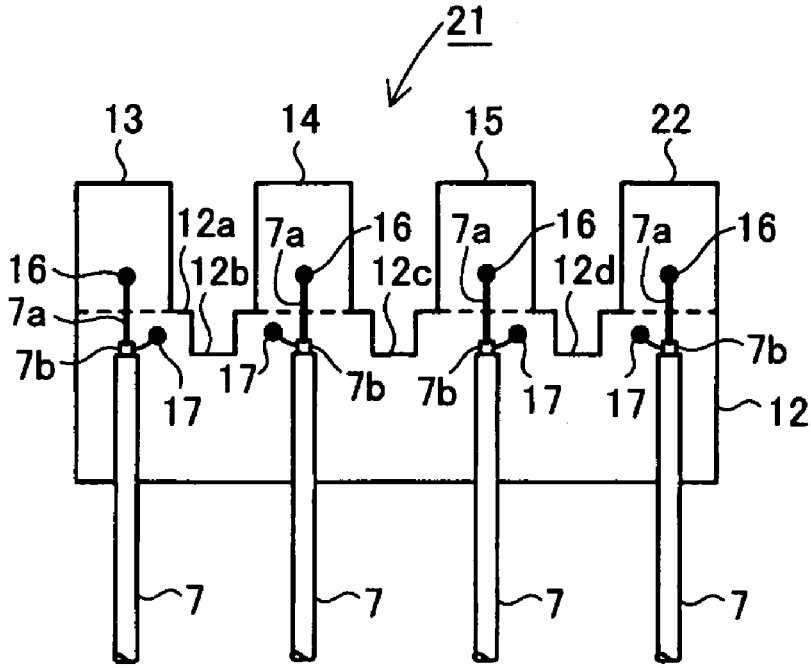

Next, an integrated multi-element planar antenna according to a second preferred embodiment of the present invention will be described below with reference to drawings. FIG. 4 is an explanatory diagram illustrating the integrated multi-element planar antenna according to the second preferred embodiment of the present invention, where FIG. 4A shows an antenna with three radiating elements and FIG. 4B shows an antenna with four radiating elements. Incidentally, like components are denoted by the same reference numerals throughout FIGS. 4A and 4B.

The integrated multi-element planar antenna 1 described above has the ground pattern 2 with the notch 2*b* formed at the end 2*a*, the first radiating element 3 placed on one side of the notch 2*b* and equipped with the feeder 5, and the second radiating element 4 placed on the other side of the notch 2*b* and equipped with a feeder 5. However, the present invention is not limited to this. As shown in FIG. 4A, the present invention includes an integrated multi-element planar antenna 11 which has a ground pattern 12, a first radiating element 13 installed at an end 12*a* of the ground pattern 12 and equipped with the feeder 16, a second radiating element 14 installed adjacent to the first radiating element 13 at the end 12*a* of the ground pattern 12 and equipped with the feeder 16, a third radiating element 15 installed adjacent to the second radiating element 14 at the end 12*a* of the ground pattern 12 and equipped with a feeder 16. As with the integrated multi-element planar antenna 1 described earlier, in the integrated multi-element planar antenna 11, grounds 17 for the feeders 16 are installed on the ground pattern 12. Each of the feeders 16 is connected with a core wire 7*a*, e.g., an inner conductor of a coaxial cable 7 serving as a feeder cable and each of the grounds 17 is connected to a braided wire 7*b* serving as an outer conductor of the coaxial cable 7.

The integrated multi-element planar antenna 11 has a first notch 12*b* formed at the end 12*a* of the ground pattern 12 between the first radiating element 13 and second radiating element 14. This makes it possible to separate characteristics between the first radiating element 13 and second radiating element 14 at the first notch 12*b*. Also, by forming a second notch 12*c* at the end 12*a* of the ground pattern 12 between the second radiating element 14 and third radiating element 15, it is possible to separate antenna characteristics between the second radiating element 14 and third radiating element 15 at the second notch 12*c*.

Also, by placing the first radiating element 13 and second radiating element 14 symmetrically about the first notch 12*b* such that separation distance will be the largest at locations where radiation fields of the first radiating element 13 and second radiating element 14 are the highest, it is possible to reduce the correlation coefficient of the antenna.

Also, by adapting the first radiating element 13 and second radiating element 14 of the integrated multi-element planar antenna 11 to the same frequency band, it is possible to support MIMO communications systems. Alternatively, the first radiating element 13 and second radiating element 14 may be adapted to different frequency bands.

Furthermore, if the wavelength corresponding to resonance frequency of the first radiating element 13 and second radiating element 14 is λ and the depth of the notch 12*b* is L, by setting L/λ to between 0.1 and 0.3 (both inclusive), it is possible to reduce the degree of coupling among the antenna elements more than when there is no notch.

FIG. 4B shows an integrated multi-element planar antenna 21 which comprises a fourth radiating element 22 installed adjacent to the third radiating element 15 at the end 12*a* of the ground pattern 12 and equipped with the feeder 16, in addition to the first radiating element 13, second radiating element 14, and third radiating element 15 shown in FIG. 4A. A third notch 12*d* is formed at the end 12*a* of the ground pattern 12 between the third radiating 15 and fourth radiating element 22. Thus, antenna characteristics can be separated between the third radiating element 15 and fourth radiating element 22 by the third notch 12*d*. Incidentally, each of the feeders 16 is connected with a core wire 7*a*, e.g., an inner conductor of a coaxial cable 7 serving as a feeder cable and each of the grounds 17 is connected to a braided wire 7*b* serving as an outer conductor of the coaxial cable 7.

By placing the third radiating element 15 and fourth radiating element 22 symmetrically about the third notch 12*d* such that separation distance will be the largest at locations where their radiation fields are the highest, it is possible to reduce the correlation coefficient of the integrated multi-element planar antenna 21.

Also, by adapting the first radiating element 13, second radiating element 14, third radiating element 15, and fourth radiating element 22 of the integrated multi-element planar antenna 21 to the same frequency band, it is possible to support MIMO communications systems. Alternatively, the first radiating element 13, second radiating element 14, third radiating element 15, and fourth radiating element 22 may be adapted to different frequency bands.

If the wavelength corresponding to a resonance frequency whose correlation is desired to be reduced among resonance frequencies of the first radiating element 13, the second radiating element 14, the third radiating element 15, and the fourth radiating element 22 is λ and depth of the first notch 12*b*, the second notch 12*c*, and the third notch 12*d* is L, by setting L/λ to between 0.1 and 0.3 (both inclusive), it is possible to reduce the degree of coupling among the antenna elements more than when there is no notch.

Figure 5:
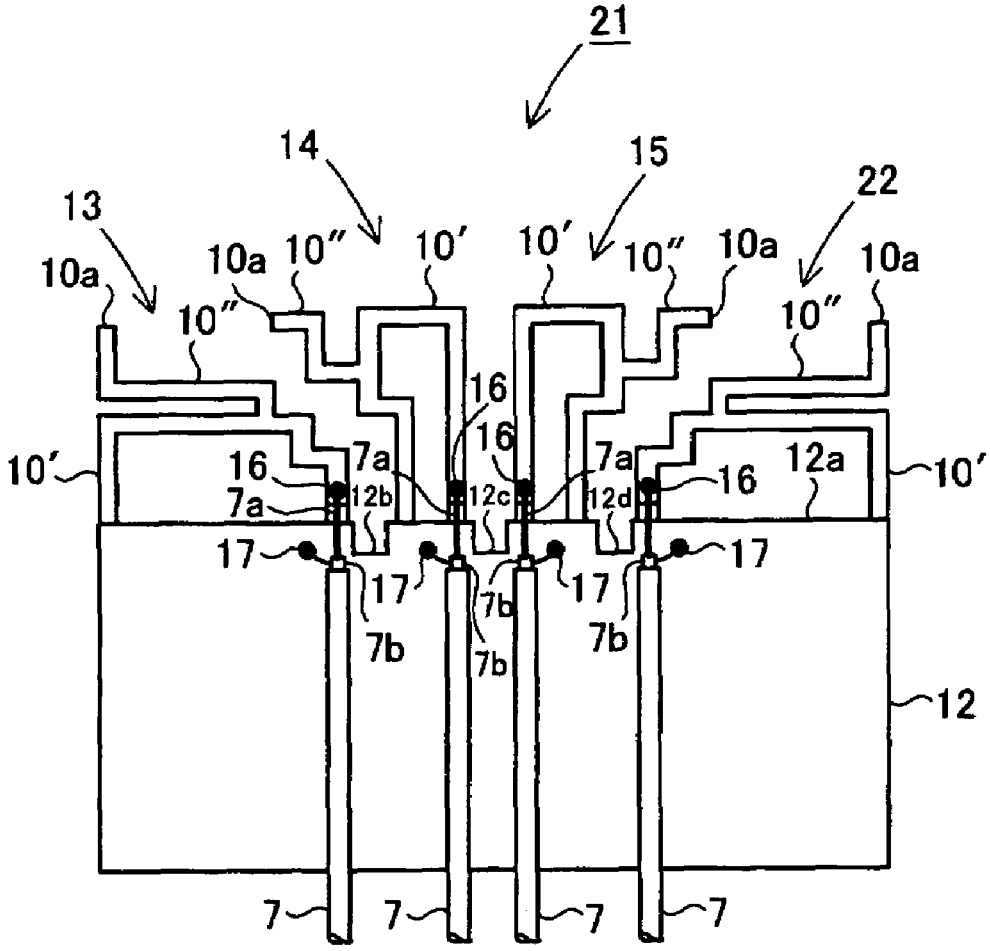
FIG. 5 is a block diagram showing an integrated multi-element planar antenna which uses composite antennas for the first radiating element, second radiating element, third radiating element, and fourth radiating element according to the second embodiment of the present invention.

If the first radiating element 13, second radiating element 14, third radiating element 15, and fourth radiating element 22 are used for a composite antenna such as described above, the loop antennas 10' of all the radiating elements are formed into approximately rectangular shapes and the monopole antennas 10" are bent, as shown in FIG. 5. Since the radiation field is the highest at the tip 10*a* of the monopole antenna 10", the monopole antenna 10" of the first radiating element 13 and monopole antenna 10" of the fourth radiating element 22 as well as the monopole antenna 10" of the second radiating element 14 and monopole antenna 10" of the third radiating element 15 are placed symmetrically with their tips 10*a* facing outward. Besides, the loop antenna 10' of the first radiating element 13 and loop antenna 10' of second radiating element 14 are recessed to avoid electromagnetic interference and so are the loop antenna 10' of the third radiating element 15 and loop antenna 10' of the fourth radiating element 22. Also, the monopole antenna 10" of the first radiating element 13 and monopole antenna 10" of the second radiating element 14 are formed into such shapes as to avoid electromagnetic interference, and so are the monopole antenna 10" of the third radiating element 15 and monopole antenna 10" of the fourth radiating element 22.

Furthermore, the first radiating element 13 has the feeder 16 installed on that side of the loop antenna 10' which is located near the first notch 12*b* of the ground pattern 12, the fourth radiating element 22 has the feeder 16 installed on that side of the loop antenna 10' which is located near the third notch 12*d* of the ground pattern 12, and the second radiating element 14 and third radiating element 15 each have the feeder 16 installed on that side of the loop antenna 10' which is located near the second notch 12*c* of the ground pattern 12. Grounds 17 for the feeders 16 are installed on the ground pattern 12. Each of the feeders 16 is connected with a core wire 7*a*, e.g., an inner conductor of a coaxial cable 7 serving as a feeder cable and each of the grounds 17 is connected to a braided wire 7*b* serving as an outer conductor of the coaxial cable 7.

Since the integrated multi-element planar antenna 21 with such composite antennas can make the monopole antennas 10" resonate with the 2.4-GHz band at ¼λ and make the loop antennas 10' resonate with the 5-GHz band at ½λ, it can fit the first radiating element 13, second radiating element 14, third radiating element 15, and fourth radiating element 22 in a space 12 mm long and 21 mm wide each and shape the ground pattern 12 into a rectangle 20 mm long and 45 mm wide. This is because the notches 12*b*, 12*c*, and 12*d* formed in the ground pattern 12 between the radiating elements allow the radiating elements to be installed close to one another. Thus, the present invention can make four-element antennas compliant with the small WFF standard.

Figure 6:
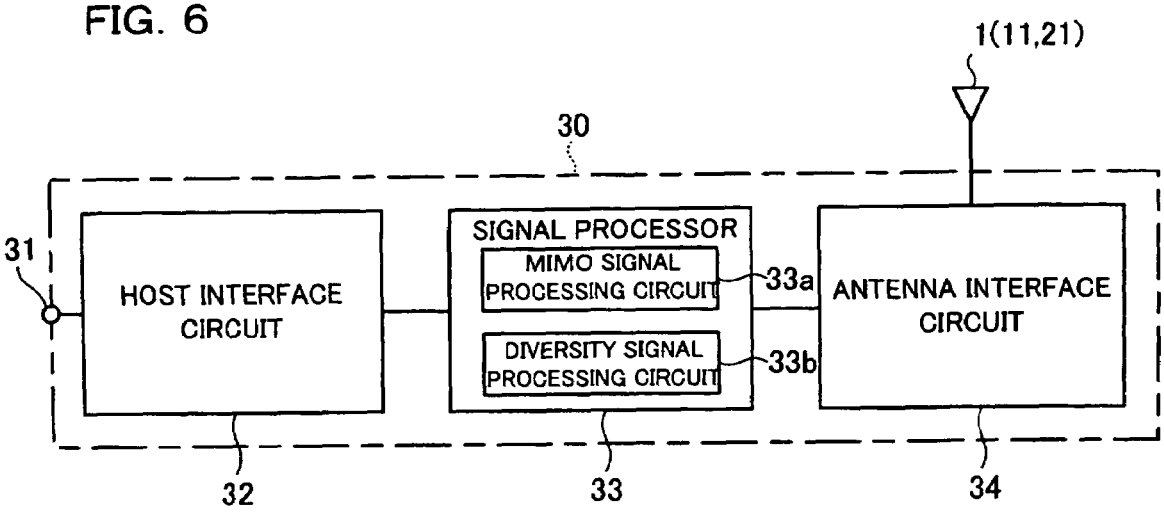
FIG. 6 is a diagram showing a circuit configuration of a wireless LAN card which employs an integrated multi-element planar antenna according to the present invention.

Since the integrated multi-element planar antennas 1, 11, and 21 configured as described above are small enough to reduce mounting space even though they are equipped with multiple radiating elements, they can be used for wireless LAN cards. FIG. 6 is a diagram showing a circuit configuration of a wireless LAN card.

The non-limiting wireless LAN card 30 shown in FIG. 6 is equipped with a host interface circuit 32 connected to a connection terminal 31, signal processor 33 connected to the host interface circuit 32, antenna interface circuit 34 connected to the signal processor 33, and integrated multi-element planar antenna 1, 11 or 21 connected to the antenna interface circuit 34. The signal processor 33 is equipped with a MIMO signal processing circuit 33*a* to support MIMO communications systems. The signal processor 33 may be equipped with a diversity signal processing circuit 33*b* to support diversity communications systems. It is because the integrated multi-element planar antenna 1, 11 or 21 can reduce the degree of coupling among the antenna elements that diversity communications systems can be supported.

The wireless LAN card 30 configured as described above is used by being inserted, for example, in a PC card slot of a notebook personal computer. Since the integrated multi-element planar antenna 1, 11 or 21 of the wireless LAN card 30 has a low degree of coupling among the antenna elements, whose directivities are selectively set to different directions, it can form different propagation paths for radio waves, and thus transmit and receive signals at high transmission speed. Therefore, the antenna can be adapted to either the MIMO communication method or the diversity communication method.

Figure 7:
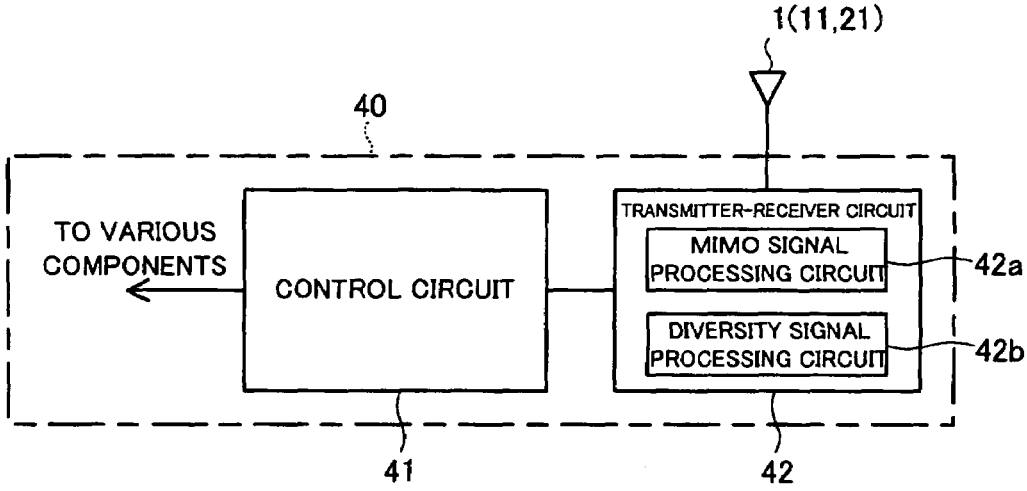
FIG. 7 is a diagram showing a circuit configuration of a wireless device which employs an integrated multi-element planar antenna according to the present invention.

Also, the integrated multi-element planar antennas 1, 11 and 21 can be used for wireless devices such as notebook personal computers and the like. FIG. 7 is a diagram showing a circuit configuration of a communications section of a notebook personal computer.

The non-limiting wireless device 40 shown in FIG. 7 is equipped with a control circuit 41, transmitter-receiver 42 connected to the control circuit 41, and integrated multi-element planar antenna 1, 11 or 21 connected to the transmitter-receiver 42. The transmitter-receiver 42 is equipped with a MIMO signal processing circuit 42*a*. The transmitter-receiver 42 may be equipped with a diversity signal processing circuit 42*b*.

If the wireless device 40 configured as described above is a notebook personal computer, since the integrated multi-element planar antennas 1, 11, and 21 are small enough to reduce mounting space even though they are equipped with multiple radiating elements, any of them can be placed without difficulty in mounting space provided in a liquid crystal panel.

Figure 8:
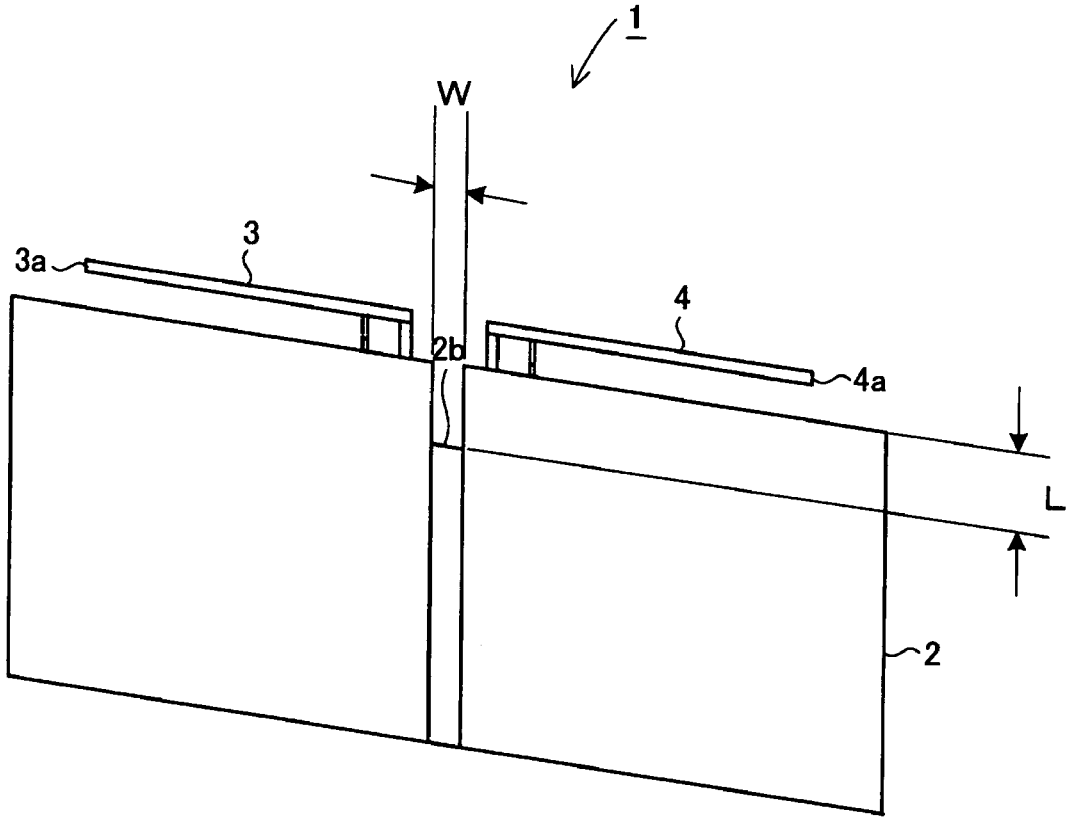
FIG. 8 is perspective view showing an integrated multi-element planar antenna which uses inverted F antennas as the first radiating element and second radiating element according to the embodiment of the present invention.

To verify the effects of notch in the integrated multi-element planar antenna according to the embodiment, an experiment was conducted using an integrated multi-element planar antenna 1 equipped with a ground pattern 2, first radiating element 3, and second radiating element 4 such as shown in FIG. 8. The first radiating element 3 and second radiating element 4 were constituted of inverted F antennas and were placed symmetrically about the notch 2*b* such that separation distance would be the largest at locations 3*a* and 4*a* where their radiation fields were the highest. The inverted F antennas are designed to resonate at ¼ the wavelength λ corresponding to their resonance frequency.

The degree of coupling (S21) among the antenna elements was checked by varying the width W of the notch 2*b* among 1 mm, 3 mm, 5 mm, 9 mm. The degree of coupling (S21) among the antenna elements was determined by measuring how much of the electric power radiated from the first radiating element 3 were transmitted to the second radiating element 4. Specifically, numerical analysis was conducted on an electromagnetic-field simulator.

Figure 9:
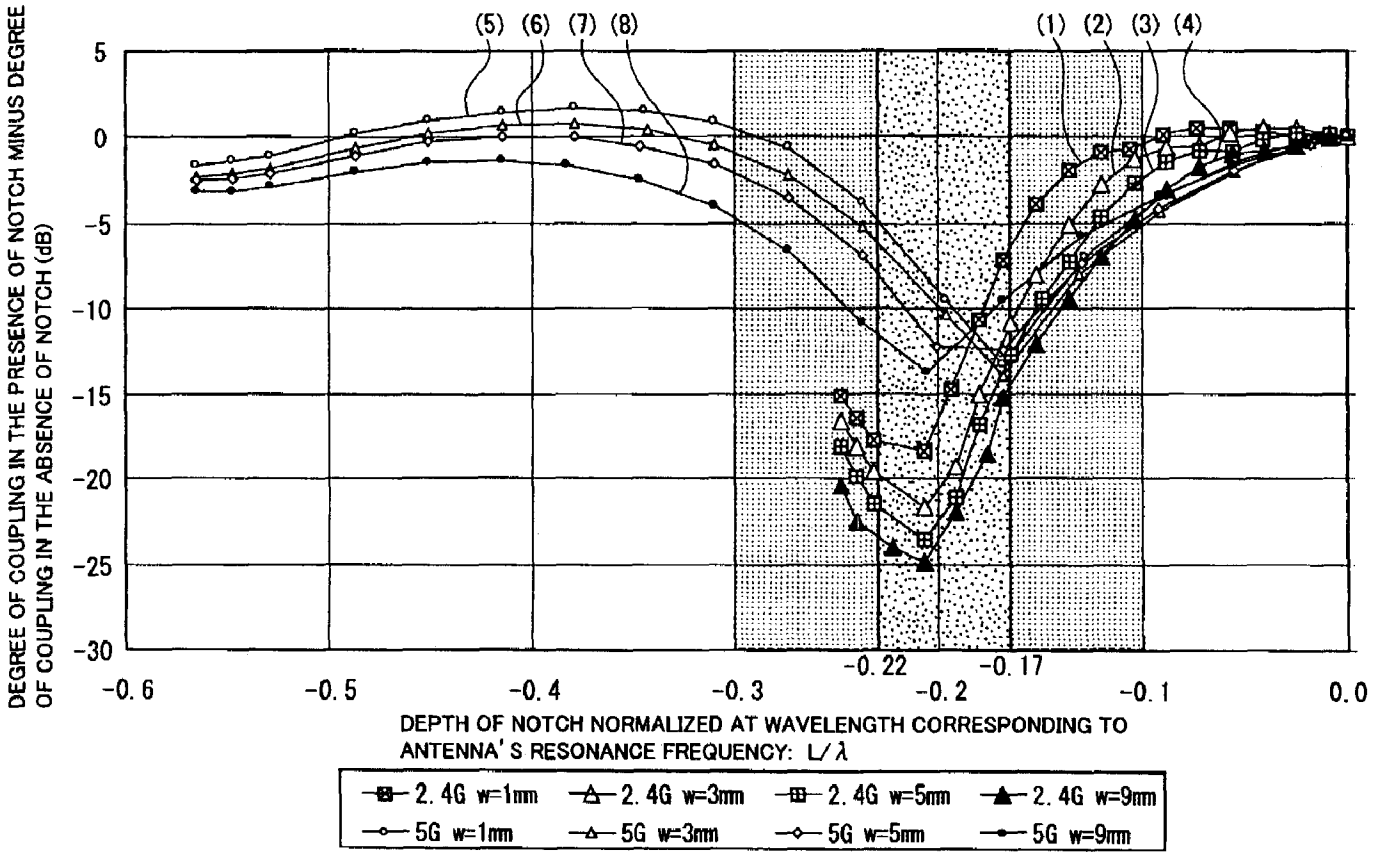
FIG. 9 is a graph of the degree of coupling among antenna elements as a function of notch depth (normalized using $L/\lambda$) using the integrated multi-element planar antenna shown in FIG. 8.

Results of the experiment are shown as a graph in FIG. 9. In the graph, the abscissa represents L/λ obtained by normalizing the depth L (mm) of the notch 2*b* at the wavelength λ (mm) corresponding to the antenna's resonance frequency while the ordinate represents the value obtained by subtracting the degree of coupling between the antenna elements in the absence of the notch from the degree of coupling between the antenna elements in the presence of the notch. The frequencies corresponding to the wavelengths used for the normalization were approximate central frequencies (2.45 GHz and 5.45 GHz) of wireless LAN's frequency bands (2.4-GHz and 5-GHz).

Referring to the graph, characteristic curve (1) was obtained when the frequency corresponding to the wavelength used for the normalization was 2.45 GHz and the width W of the notch 2*b* was 1 mm, characteristic curve (2) was obtained when the frequency corresponding to the wavelength used for the normalization was 2.45 GHz and the width W of the notch 2*b* was 3 mm, characteristic curve (3) was obtained when the frequency corresponding to the wavelength used for the normalization was 2.45 GHz and the width W of the notch 2*b* was 5 mm, and characteristic curve (4) was obtained when the frequency corresponding to the wavelength used for the normalization was 2.45 GHz and the width W of the notch 2*b* was 9 mm. Also, characteristic curve (5) was obtained when the frequency corresponding to the wavelength used for the normalization was 5.45 GHz and the width W of the notch 2*b* was 1 mm, characteristic curve (6) was obtained when the frequency corresponding to the wavelength used for the normalization was 5.45 GHz and the width W of the notch 2*b* was 3 mm, characteristic curve (7) was obtained when the frequency corresponding to the wavelength used for the normalization was 5.45 GHz and the width W of the notch 2*b* was 5 mm, and characteristic curve (8) was obtained when the frequency corresponding to the wavelength used for the normalization was 5.45 GHz and the width W of the notch 2*b* was 9 mm.

As can be seen from the graph in FIG. 9, the degree of coupling (S21) among the antenna elements is reduced when L/λ is between 0.1 and 0.3 (both inclusive) in all the characteristic curves (1) to (8). The reduction in the degree of coupling (S21) among the antenna elements is remarkable especially when L/λ is between 0.17 and 0.22. Incidentally, the width W of the notch 2*b* in the range of 1 mm to 9 mm does not have much impact on the degree of coupling (S21) among the antenna elements.

Although integrated multi-element planar antennas with two, three, or four radiating elements have been disclosed in the above embodiments, it is to be understood that the present invention is not limited to this. In general, an integrated multi-element planar antenna according to the present invention may comprise a ground pattern, n radiating elements placed adjacent to each other at an end of the ground pattern and each equipped with a feeder, and a total of n−1 notches formed between the n radiating elements at the end of the ground pattern. That is, the number of radiating elements is not limited as long as a notch is formed between each pair of adjacent radiating elements, thereby reducing the degree of coupling (S21) among the antenna elements. Also, by placing the radiating elements in each pair symmetrically about the notch such that separation distance will be the largest at locations where their radiation fields are the highest, it is possible to reduce the correlation coefficient of the antenna.

While the particular PLANAR ANTENNA WITH MULTIPLE RADIATORS AND NOTCHED GROUND PATTERN is herein shown and described in detail, it is to be understood that the subject matter which is encompassed by the present invention is limited only by the claims.

What is claimed is:

1. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein the first radiating element and the second radiating element are configured for two frequency bands each.

2. The integrated multi-element planar antenna according to claim 1, wherein the first radiating element and the second radiating element share at least one common frequency band.

3. The integrated multi-element planar antenna according to claim 2, wherein the common frequency band is the 2.4-GHz band and the first radiating element and the second radiating element resonate with frequencies in the 2.4-GHz band at a quarter-wavelength.

4. The integrated multi-element planar antenna according to claim 1, wherein the two frequency bands are the 2.4-GHz band and 5-GHz band.

5. The integrated multi-element planar antenna according to claim 1, wherein the first radiating element and the second radiating element are placed symmetrically about the notch.

6. The integrated multi-element planar antenna according to claim 1, wherein the ground pattern, the first radiating element, and the second radiating element are formed on a dielectric.

7. The integrated multi-element planar antenna according to claim 1, wherein the ground pattern, the first radiating element and the second radiating element are formed by etching a conductor layer of a printed circuit board.

8. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein the first radiating element and the second radiating element are configured for respective frequency bands that are different from each other.

9. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein at least one the first radiating element or the second radiating element is configured as an inverted F antenna having two parallel segments spaced from each other and perpendicularly joining a common segment.

10. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein at least one the first radiating element or the second radiating element is configured as a meander line antenna.

11. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein at least one the first radiating element or the second radiating element is a monopole antenna.

12. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein the planar antenna integrates a loop antenna and a monopole antenna.

13. An integrated multi-element planar antenna comprising:

at least one ground pattern with a notch formed at an end;

at least a first radiating element connected to a feeder and placed on a first side of the notch; and at least a second radiating element connected to a feeder and placed on a second side of the notch, wherein the first radiating element and the second radiating element are placed such that the distance between them is relatively large at locations where radiation fields of the first radiating element and the second radiating element are the highest.

14. An integrated multi-element planar antenna comprising:

at least one around pattern with a notch formed at an end;

at least a first radiating element connected to a feeder and placed on a first side of the notch; and at least a second radiating element connected to a feeder and placed on a second side of the notch, wherein if a wavelength corresponding to a resonance frequency of the first radiating element and the second radiating element is $\lambda$ and depth of the notch is L, then $1/\lambda$ is between 0.1 and 0.3 inclusive.

15. An integrated multi-element planar antenna comprising:

a ground pattern;

at least a first radiating element juxtaposed with the ground pattern and associated with a feeder;

at least a second radiating element juxtaposed with the ground pattern and associated with a feeder; and at least a third radiating element disposed adjacent to the second radiating element and equipped with a feeder, wherein a first notch is formed in the ground pattern between the first radiating element and the second radiating element.

16. The integrated multi-element planar antenna according to claim 15, wherein a second notch is formed in the ground pattern between the second radiating element and the third radiating element.

17. The integrated multi-element planar antenna according to claim 15, wherein the first radiating element and the second radiating element are placed symmetrically about the first notch such that separation distance will he the largest at locations where radiation fields of the first radiating element and the second radiating element are the highest.

18. The integrated multi-element planar antenna according to claim 15, further comprising a fourth radiating element installed adjacent to the third radiating element and associated with a feeder, wherein a third notch is formed in the ground pattern between the third radiating element and the fourth radiating element.

19. The integrated multi-element planar antenna according to claim 18, wherein the first radiating element and the second radiating element are placed symmetrically about the first notch such that separation distance will be the largest at locations where radiation fields of the first radiating element and the second radiating element are the highest while the third radiating element and the fourth radiating element are placed symmetrically about the third notch such that separation distance will be the largest at locations where radiation fields of the third radiating element and the fourth radiating element are the highest.

20. The integrated multi-element planar antenna according to claim 18, wherein the first radiating element, the second radiating element, the third radiating element, and the fourth radiating element are configured for the same frequency band.

21. The integrated multi-element planar antenna according to claim 18, wherein a wavelength corresponding to a resonance frequency whose correlation is desired to be reduced among resonance frequencies of the first, radiating element, the second radiating element, the third radiating element, and the fourth radiating element is $\lambda$ and depth of the first notch, the second notch, and the third notch is L, and $L/\lambda$ is between 0.1 and 0.3 inclusive.

22. A wireless LAN card comprising:

a host interface circuit;

a signal processor connected to the host interface circuit;

an antenna interface circuit connected to the signal processor; and an integrated multi-element planar antenna connected to the antenna interface circuit, wherein the integrated multi-element planar antenna includes at least two radiating elements separated from each other by a notch formed in a ground pattern that is electrically connected to the radiating elements.

23. The wireless LAN card according to claim 22, further comprising a MIMO signal processing circuit.

24. An electronic apparatus comprising:

a transmitter-receiver; and an integrated multi-element planar antenna connected to the transmitter-receiver, wherein the integrated multi-element planar antenna includes at least two radiating elements separated from each other by a notch in a ground pattern that is electrically connected to the radiating elements wherein the transmitter-receiver comprises a MIMO signal processing circuit.

25. An electronic apparatus comprising:

a transmitter-receiver; and an integrated multi-element planar antenna connected to the transmitter-receiver, wherein the integrated multi-element planar antenna includes at least two radiating elements separated from each other by a notch formed in a ground pattern that is electrically connected to the elements wherein the transmitter-receiver comprises a diversity signal processing circuit.

* * * * *